US005587726A

United States Patent [19]

Moffat

[11] Patent Number: 5,587,726

[45] Date of Patent: Dec. 24, 1996

[54] METHOD AND APPARATUS FOR INCREASING THE SPEED OF OPERATION OF A DOUBLE BUFFERED DISPLAY SYSTEM

[75] Inventor: Guy Moffat, Palo Alto, Calif.

[73] Assignee: Sun Microsystems, Inc., Mountain View, Calif.

[21] Appl. No.: 319,474

[22] Filed: Oct. 6, 1994

Related U.S. Application Data

[63] Continuation of Ser. No. 914,991, Jul. 16, 1992, abandoned, which is a continuation of Ser. No. 632,016, Dec. 21, 1990, abandoned.

[51] Int. Cl.[6] ..... G09G 5/00

[52] U.S. Cl. ..... 345/201; 345/202

[58] Field of Search ..... 345/200, 201, 345/203, 190; 348/560

[56] References Cited

U.S. PATENT DOCUMENTS

| | | | |
|---|---|---|---|
| 4,367,466 | 1/1983 | Takeda et al. | 340/724 |
| 4,716,460 | 12/1987 | Benson et al. | 340/750 |
| 4,742,350 | 5/1988 | Ko et al. | 340/799 |
| 4,758,881 | 7/1988 | Laspada | 340/798 |
| 4,818,932 | 4/1989 | Odenheimer | 340/798 |
| 4,849,937 | 7/1989 | Yoshimoto | 340/799 |
| 4,864,517 | 9/1989 | Maine et al. | 340/747 |
| 4,910,505 | 3/1990 | Beaven et al. | 340/799 |
| 4,924,415 | 5/1990 | Winser | 340/750 |
| 4,933,846 | 6/1990 | Humphrey et al. | 364/200 |
| 5,161,221 | 11/1992 | Van Nostrand | 340/750 |

OTHER PUBLICATIONS

IDT (AN–02)—Integrated Device Technology, Inc., High-Speed CMOS Data Book, AN–02 Application Note–2 pp. 14–9 to 14–21, 1988.

*Primary Examiner*—Steven Saras

*Attorney, Agent, or Firm*—Blakely Sokoloff Taylor & Zafman, LLP

[57] ABSTRACT

An output display system including an output display; apparatus for controlling the writing of information to the output display; and a double buffered memory including a first bank of video random access memory for furnishing information to the output display, a second bank of video random access memory for furnishing information to the output display, and apparatus for addressing alternate banks of memory as each line of the output display in a frame is written.

10 Claims, 2 Drawing Sheets

METHOD AND APPARATUS FOR INCREASING THE SPEED OF OPERATION OF A DOUBLE BUFFERED DISPLAY SYSTEM

This is a continuation of application Ser. No. 07/914,991 filed on Jul. 16, 1992 now abandoned, which is a Continuation of prior application Ser. No. 07/632,016 filed on Dec. 21, 1990 now abandoned.

BACKGROUND OF THE INVENTION

1. Field of the Invention

This invention relates to display systems for computers and, more particularly, to methods and apparatus for accelerating the transfer of graphical information to frame buffers in a double buffered display system.

2. History of the Prior Art

Computer systems use a buffer memory called a frame buffer for storing data which is to be written to an output display. The information in the frame buffer is written to the display line-by-line generally beginning at the upper left-hand corner of the display and continuing to the lower right-hand corner. One frame of information is followed by the next so that thirty frames are furnished each second. As the picture in one frame changes to the picture in the next, continuous motion is presented. To accomplish this, a frame buffer must be continuously updated.

Typically, a frame buffer is constructed of video random access memory arrays which differ from conventional random access memory arrays by having a first random access port at which the memory may be read or written and a second line-at-a-time serial output port which furnishes pixel data to the circuitry controlling the output display. Such a construction allows information to be written to the frame buffer while the frame buffer continually furnishes information to the output display.

The ability of a frame buffer to both receive information and transfer that information to an output display simultaneously causes certain difficulties. If information being furnished to the display changes during the time that a single frame is being furnished, then the display may present information from more than one time period. This is called a frame tear. Frame tears are only important where motion from one frame to the next causes the elements presented on the display to be obviously distorted. When this occurs, the distortion caused may be extremely disconcerting to the viewer.

To eliminate frame tears, certain more expensive computer systems utilize what is referred to as double buffering. Double buffering provides two frame buffers both of which furnish pixel information to the circuitry controlling the output display. One of the frame buffers is selected to provide information for a particular frame on the output display, and no information is provided to that frame buffer while the information it stores is being transferred for display. The other frame buffer, in the meantime, receives all of the new information to be displayed. When the display is to be changed, the second frame buffer is selected to transfer pixel information to the output display and the first buffer to receive new pixel information. In this manner, no pixel information is ever written to a frame buffer while the information in the frame buffer is being written to the display. The effect of this is that frame tears cannot occur.

However, even though frame tears do not occur with double buffering, the video random access memory used for frame buffer memory is not being utilized as fully as it would be in a system using a single frame buffer because at no time is a buffer both being updated and furnishing information to the output display. Video random access memory is expensive, and it would be desirable to better utilize that memory in a double buffered display system.

SUMMARY OF THE INVENTION

It is, therefore, an object of the present invention to increase the speed of operation of a computer display system which utilizes double buffering.

It is another more specific object of the present invention to allow a double buffered computer display system to operate more rapidly in presenting vertical lines on the output display.

These and other objects of the present invention are realized in an output display system comprising an output display; means for controlling the writing of information to the output display; and a double buffered memory including a first bank of video random access memory for furnishing information to the output display, a second bank of video random access memory for furnishing information to the output display, and means for addressing alternate banks of memory as each line of the output display in a frame is written.

These and other objects and features of the invention will be better understood by reference to the detailed description which follows taken together with the drawings in which like elements are referred to by like designations throughout the several views.

NOTATION AND NOMENCLATURE

Some portions of the detailed descriptions which follow are presented in terms of symbolic representations of operations on data bits within a computer memory. These descriptions and representations am the means used by those skilled in the data processing arts to most effectively convey the substance of their work to others skilled in the art. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most cases in any of the operations described herein which form part of the present invention;

the operations are machine operations. Useful machines for performing the operations of the present invention include general purpose digital computers or other similar devices. In all cases the distinction between the method operations in operating a computer and the method of computation itself should be borne in mind. The present invention relates to apparatus and to method steps for operating a computer in processing electrical or other (e.g. mechanical, chemical) physical signals to generate other desired physical signals.

DETAILED DESCRIPTION OF THE INVENTION

Figure 1:
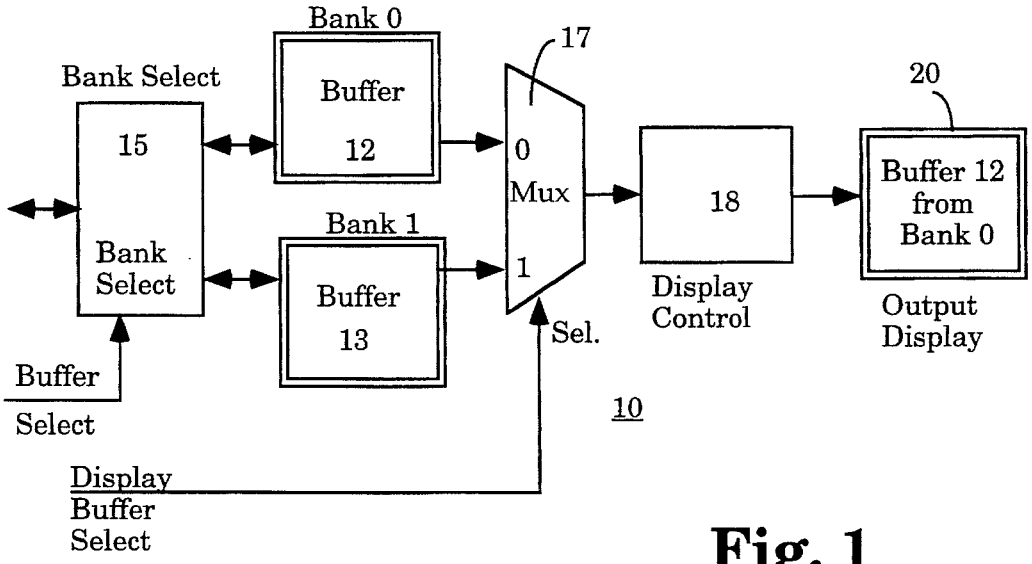
Fig. 1 (Prior Art)
FIG. 1 is a block diagram illustrating a conventional double buffered output display.

Referring now to FIG. 1, there is illustrated an output display system 10 constructed in accordance with the prior art. The display system 10 includes a first frame buffer 12 and a second frame buffer 13. Each frame buffer 12 and 13 is typically a single bank of memory devices. Thus, a single bank 0 constitutes the buffer 12 and a single bank 1 constitutes the buffer 13. The frame buffers 12 and 13 are typically constructed of video random access memory and are constructed with addressing facilities so that they are referred to as two ported. Essentially, this means that each of the frame buffers 12 and 13 includes a first means for addressing to provide random access to the storage positions within the memory and a second means for accessing the memory serially so that lines of information may be provided for presentation on an output display.

Also included in the display system 10 is circuitry for selecting the particular one of the frame buffers 12 or 13 which is to be written to or from which information is to be read on a random access basis. For the purpose of this figure, the circuitry for randomly accessing the two buffers 12 and 13 is represented by a bank select circuit 15 the details of which are not important to the understanding of this invention and are well known to those skilled in the art. At the output of the buffers 12 and 13 is illustrated a multiplexor 17 which represents the circuitry for providing the line-by-line serial output from the buffers 12 and 13 and for selecting between those buffers. The line-by-line serial output is transferred by display control circuitry 18 to an output display 20.

In operation, the information in one of the display buffers 12 or 13 is transferred out a line at a time until a complete frame has been transferred to the display 20. For example, the display 20 illustrates that buffer 12 from physical bank 0 as being displayed. During the period of transfer from the buffer 12, information for updating the display 20 may be provided by the bank select circuitry 15 to selected addresses within the buffer 13. When a complete frame has been written from the frame buffer 12 to the display 20, the circuitry 17 may select the buffer 13 so that the display information therein will be transferred to the display 20. During the period information is actually being transferred from the serial port of the buffer 13 to the display 20, any new updating information is furnished by the circuitry 15 to the buffer 12.

Since no information is being transferred to a frame buffer during a period in which the display 20 is being updated from that buffer, each frame of information presented on the display 20 is provided from a buffer which contains information correct for the instant of time at which the frame is presented. Consequently, frame tears cannot occur using such a system.

However, it will be recognized that each of the frame buffers 12 and 13 is two ported so that it may be receiving information through its the random access ports while information is being transferred to the display 20 through its serial output ports. This, of course, is the typical manner in which a system using a single frame buffer operates. Thus, although both ports are not utilized simultaneously in a double buffered system, the two ports are retained because of the convenience of their use in typical systems. However, the circuitry is clearly under utilized when compared to its use in single buffered systems.

The present invention makes use of the two ported accessing arrangements typical to frame buffers so that each bank of memory used in a double buffered system is both updated and furnishes information to the output display simultaneously. The invention allows this simultaneous use while retaining the advantages of double buffering so that frame tears do not occur. This is accomplished by treating the two physical banks of memory which are typical of a double buffered display system, not as individual frame buffers, but as banks from which two frame buffers may be constructed. In a sense, the two frame buffers may be considered as virtual frame buffer memories and the two banks of memory in which they reside as the physical frame buffer memory used to provide storage for the two virtual frame buffers.

Figure 2:
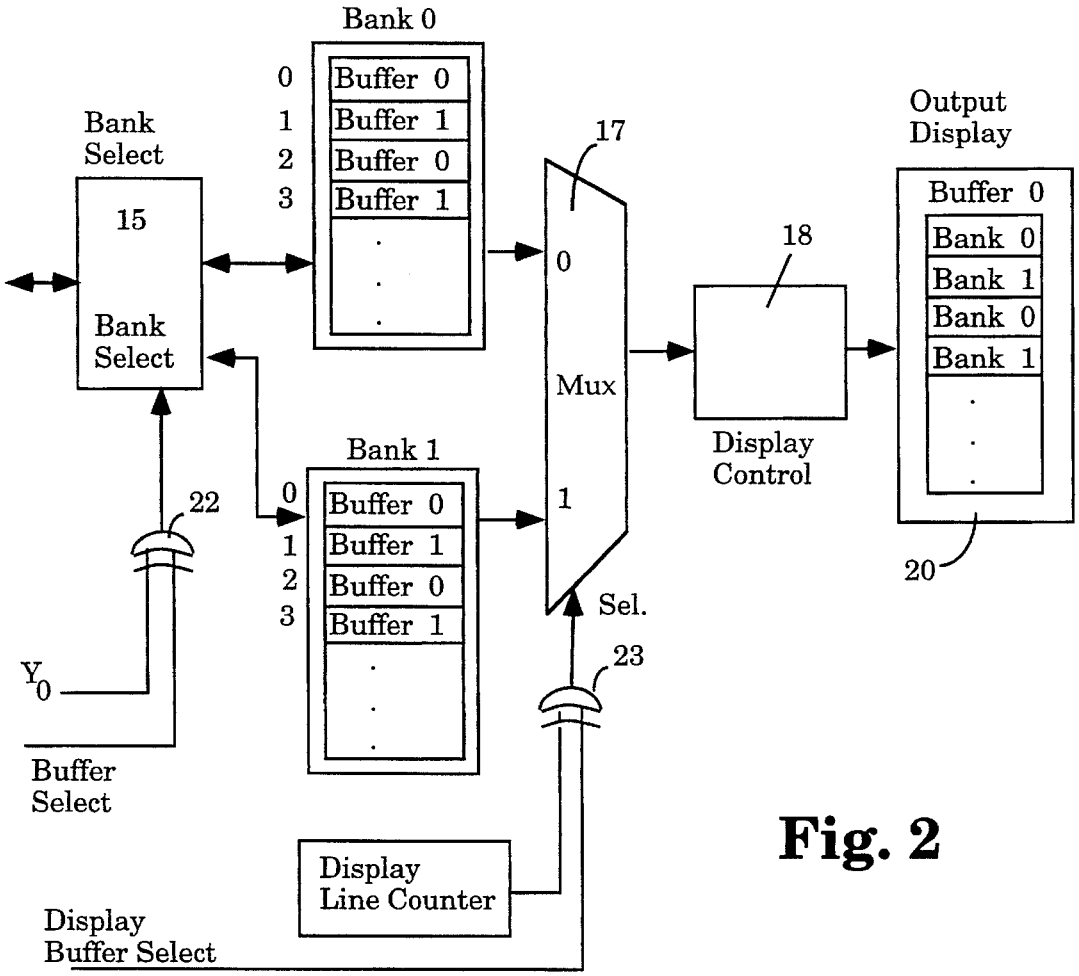
FIG. 2 is a block diagram illustrating a double buffered output display constructed in accordance with the present invention.

In arranging the addressing circuitry of such a system, alternate lines of memory are used in each of the two banks of memory for each frame buffer. FIG. 2 illustrates such an arrangement. In FIG. 2, the two single banks 0 and 1 of physical video random access memory are shown both containing alternate lines of two virtual frame buffers. A first frame buffer 0 may be considered to consist of a first line 0 in one memory bank 0, a second line 1 in a second memory bank 1, a third line 2 in the first memory bank 0, a fourth line 3 in the second memory bank 1, and so on through alternating lines in each of the memory banks. Thus, the first frame buffer 0 includes the same number of lines as does a typical frame buffer used in a typical double buffered display system except that alternate lines of the frame buffer reside in alternate memory banks. In a like manner, second frame buffer 1 may be considered to consist of a first line 0 in memory bank 1, a second line 1 in memory bank 0, a third line 2 in memory bank 1, a fourth line 3 in memory bank 0, and so on through alternating lines in each of the memory banks. Similar to the first frame buffer 0, the second frame buffer 0 includes the same number of lines as does a typical frame buffer used in a double buffered display system except that alternate lines of the frame buffer reside in alternate memory banks.

When a frame of pixels is written to the output display, all of the lines of the frame come from the same frame buffer (e.g., frame buffer 0). However, the first line of the frame is written from one of the banks of memory (e.g., bank 0), and the next line of the frame is written from bank 1. Then the third line is written from bank 0; and the fourth line is written from bank 1. This continues throughout the time any individual frame is written from any individual frame buffer for display. During that time, no information is written to update those particular lines of the two banks of memory which constitute this virtual frame buffer 0. For this reason, no frame tear may occur in the first frame. On the other hand, those lines of the two physical banks of memory which are not in the virtual frame buffer 0 being written to the display may be updated during the time this first frame is being written to the display.

In a similar manner, when an updated frame is to be presented on the display, the second virtual frame buffer 1 is used to furnish this frame to the display. Thus, the first line 0 of the updated or second frame is written from the other one of the banks of memory (i.e.., bank 1). The next line 1 of the frame is written from bank 0. The third line 2 is written from bank 1; and the fourth line 3 is written from bank 0. This sequence continues throughout the time this individual frame is being written. As with the previous frame buffer, no information is written to update those lines of the two banks of physical memory which constitute the second frame buffer. For this reason, no frame tear may occur in the second frame. On the other hand, those lines of the two banks which are not in the second virtual frame buffer being written to the display may be updated during the time this second frame is being written to the display. Although this may seem like a very complicated way in which to access frame buffers to simply provide a display which offers the same advantages as does a typical double buffered display system, the system of the present invention offers substantial advantages over prior art systems. Those skilled in the art will recognize that the operation of the display is particularly slow in the vertical direction using conventional frame buffers. The present invention offers particular advantages in describing lines on the display which are other than horizontal. For example, in a conventional arrangement, when a vertical line is being written to the frame buffer, the addressing circuitry is used to write a first pixel on a first line. After that pixel has been written, the addressing circuitry may be used to access a second pixel on a next line. In the present invention, two different banks are involved so that a first pixel may be written to the first bank and before that operation is complete, a second pixel may be written to the second bank. This allows write operations to be interleaved for writing vertical or other non-horizontal lines to the frame buffer. Thus the writing of alternate banks in the same virtual frame buffers takes half as long as in a conventional double buffered system.

Figure 3:
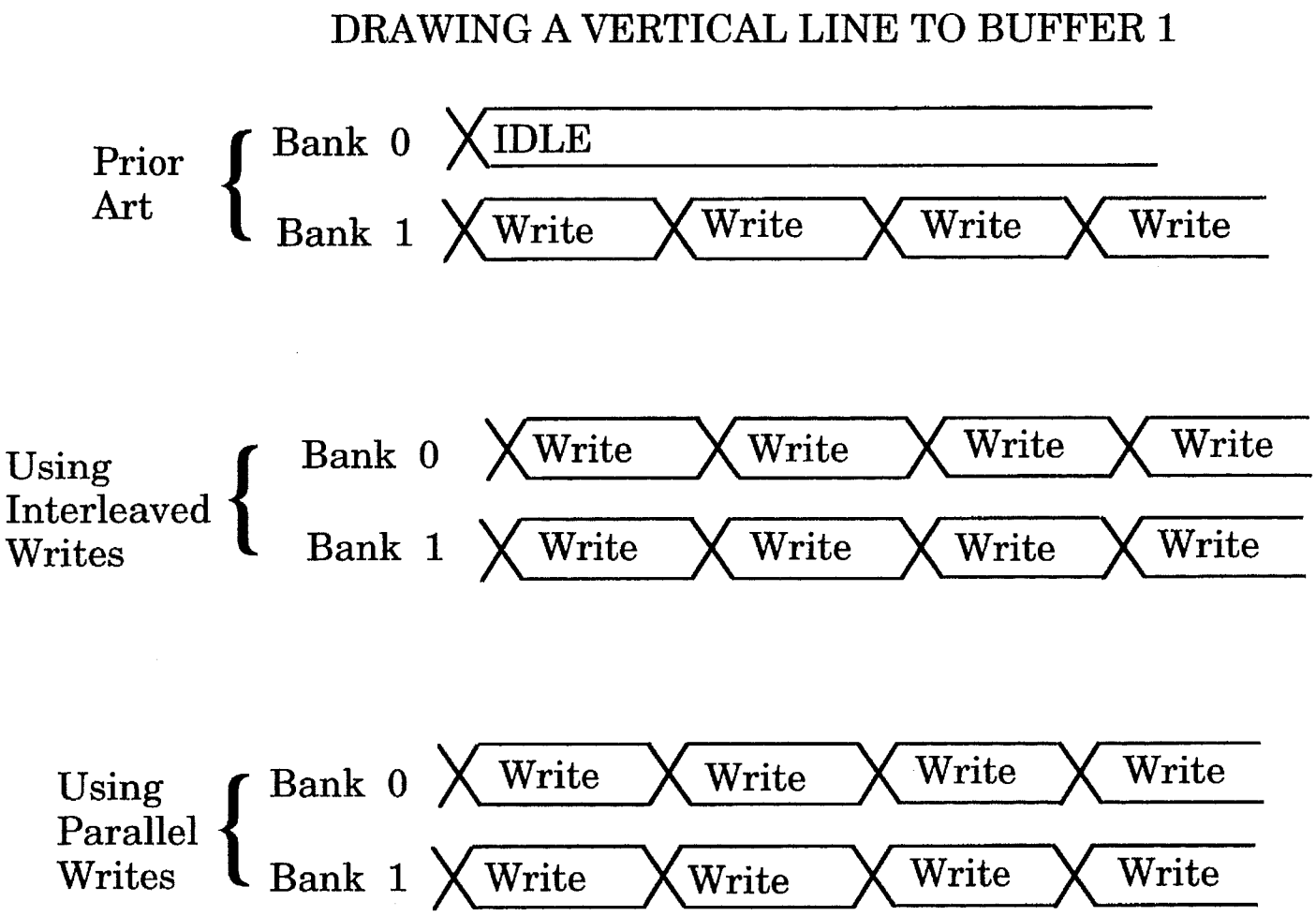
FIG. 3 is a timing diagram useful in understanding the invention.

The advantages are very apparent from a review of the timing diagrams for the operations. For example, as may be seen from the upper two lines of timing diagrams in FIG. 3, in a typical frame buffer of the prior art, the read and write functions can only take place in a serial fashion. Moreover, only one of the two frame buffers may be addressed at one time since information cannot be written into the buffer which is being described on the display or a frame tear will occur. FIG. 3 illustrates in the second line of the timing diagram the cycles required for sequential write accesses in a typical frame buffer operation.

On the other hand, in the arrangement of the present invention, because alternate rows of the virtual frame buffers appear in different banks of video random access memory, when a write operation for a non-horizontal line occurs, for example, the information in sequential accesses is directed to different banks. Because different banks of memory are utilized for sequential read or write operations, the periods in which these functions are accomplished may be overlapped. The middle pair of timing diagrams in FIG. 3 illustrate this. A write operation occurs, and the information is available on the access lines. Once the first write has begun, a second write operation to the other bank of memory may commence and overlap the write operation to the first memory bank. Moreover, it is also possible to write to each of the two banks in parallel as illustrated in the lowest pair of timing diagrams in FIG. 3. This, however, requires somewhat more complicated accessing circuitry. Thus, as is clear from the timing diagrams shown in FIG. 3, the operations of the frame buffers of this invention may occur in approximately half the time required to accomplish the same functions in a typical double buffered system of the prior art.

FIG. 3 illustrates circuitry in accordance with the present invention for accessing the banks of memory used for the virtual frame buffers to provide interleaved random access operations. As may be seen, in accessing the memory banks for either of the two ports, the buffer select signal (which may be a single bit signifying one or the other of the two virtual frame buffers) and the least significant bit of the Y address are transferred to an exclusive OR (XOR) gate 22. If the least significant bit of the Y address ends in a zero, the buffer select value will be transferred to accomplish the selection. If, on the other hand, the least significant bit of the Y address is a one, the value of the buffer select signal is complemented. Since every other Y address to a normal frame buffer ends in a one while the lines between end in zeroes, every other line will have its buffer select address complemented. This complementing provides access on a line by line basis which alternates between the two banks.

To write the information to the output display, the display buffer select signal is transferred to an exclusive OR circuit 23 along with the lowest order bit furnished by the display line counter. The value produced by this operation is used to select the proper bank of memory for the line to be transferred to the display.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A double-buffered frame buffer system for writing to an output display comprising:

a first bank of two-ported video random access memory for furnishing portions of a first frame of information to the output display through its first port and for concurrently receiving information through its second port to update lines in a second frame of information not being currently furnished to the output display, wherein each frame includes all lines of a complete display image, such that said first and second ports of said first bank are concurrently used for receiving and outputting information;

a second bank of two-ported video random access memory for furnishing all remaining portions of said first frame of information to the output display through its first port and for concurrently receiving information through its second port to update lines in said second frame of information not being currently furnished to the output display such that said first and second ports of said second bank are concurrently used for receiving and outputting information;

said first and second banks simultaneously storing all information corresponding to said first frame and portions of said second frame;

means for alternatively addressing said first and second banks of memory as each line in said first frame is written to the output display, said first frame having its lines interleaved between said first and second banks of said memory;

means for addressing said first and second banks of memory to write information to update lines in said second frame not being currently furnished to the output display, said second frame having its lines interleaved between said first and second banks of said memory; and means for controlling the writing of lines in said first frame of information to the output display by selecting alternate lines constituting said first frame from said first bank and said second bank.

2. The system of claim 1 in which the means for alternatively addressing said first and second banks of memory comprises means for selecting every other line from one of the first and second memory banks.

3. The system of claim 1 in which the means for selecting every other line from one of the first and second memory banks comprises means for complementing a buffer select value on alternate lines of a frame.

4. The system of claim 1 further comprising means for storing a frame to be displayed in interleaved lines of the first and second memory banks of memory.

5. The system of claim 4 in which the means for storing comprises means for storing every other line of the frame to be displayed in one of the first and second memory banks.

6. The system of claim 5 in which the means for storing every other line from one of the first and second memory bank comprises means for complementing a buffer select value on alternative lines of a frame.

7. A double-buffered frame buffer system for writing to a video display system, comprising:

first and second banks of two-port video random access memory, said first and second banks each having first and second ports, with the first and second ports of the first bank configured for concurrently receiving and outputting video display information;

an element for storing entire first and second frames of video display information in said banks, with said first and second frames each having lines interleaved between said first and second banks and wherein each frame includes all lines of a completed display image;

an element for reading said first frame video display information from said first and second banks; and an element for updating a portion of said second frame video display information stored in said first and second banks, said means for updating a portion of said second frame operating concurrently with said means for reading said first frame.

8. A double-buffered method for writing to a video display system having first and second banks of two-port video display random access memory, comprising the steps of:

storing entire first and second frames of video display information in said first and second banks, with said first and second frames each having lines interleaved between said first and second banks and wherein each frame includes all lines of a complete display image, said first and second banks each having first and second ports, with the first and second ports of the first bank configured for concurrently receiving and outputting video display information;

reading said first frame of a video display information from said first and second banks, and updating a portion of said second frame of video display information, said step of updating a portion of said second frame being performed concurrently with said step of reading said first frame.

9. The method of claim 8, wherein said step of updating said second frame of video display information includes the step of updating video display information stored in said first bank while concurrently updating video display information stored in said second bank.

10. A double-buffered frame buffer system for writing to an output display comprising:

a first bank of two-ported video random access memory for furnishing portions of a first frame with information to the output display through a first port and for concurrently receiving information through a second port to update lines in a second frame of information not being currently furnished to the output display, wherein each frame includes all lines of a complete display image and the first and second ports of the first bank are concurrently used for receiving and outputting information;

a second bank of two-ported video random access memory for furnishing all remaining portions of the first frame of information to the output display through a first port and for concurrently receiving information through a second port to update lines in the second frame of information not being currently furnished to the output display with the first and second ports of the second bank concurrently used for receiving and outputting information;

said first and second banks simultaneously storing all information corresponding to the first frame and portions of the second frame;

a bank select unit connected to the second ports of the first and second banks, said bank select unit receiving the first and second frames of information and routing portions of the first and second frames to the first and second banks;

a multiplexer having first and second inputs connected, respectively, to the first ports of the first and second banks for receiving information therefrom and for selectively outputting information either from the first bank or the second bank in accordance with a display buffer select value;

a display control circuit, connected to an output of said multiplexer, for receiving information therefrom; and an output display buffer for receiving information from the display control circuit and for routing said information to the output display.

* * * * *